US005673540A

United States Patent [19]

Sanukiya et al.

[11] Patent Number: 5,673,540

[45] Date of Patent: Oct. 7, 1997

[54] METHOD AND APPARATUS FOR PUTTING CELLS INTO A BOX

[75] Inventors: Toshio Sanukiya, Katano; Minoru Kouda, Hirakata; Ichiro Murata, Kadoma, all of Japan

[73] Assignee: Matsushita Electric Industrial Co., Ltd., Osaka, Japan

[21] Appl. No.: 706,810

[22] Filed: Sep. 3, 1996

[30] Foreign Application Priority Data

Sep. 6, 1995 [JP] Japan ..... 7-228767

[51] Int. Cl.[6] ..... B65B 35/30

[52] U.S. Cl. ..... 53/448; 53/245; 53/247; 53/248; 53/251; 53/475; 53/536; 53/537; 198/690.1; 414/793.3

[58] Field of Search ..... 198/690.1; 209/904, 209/907; 414/793.2, 793.3; 53/245, 247, 248, 249, 251, 475, 447, 448, 536, 537, 540

[56] References Cited

U.S. PATENT DOCUMENTS

| | | | |
|---|---|---|---|
| 2,848,098 | 8/1958 | Talbot | 198/690.1 X |
| 3,010,562 | 11/1961 | Roehrbein et al. | 198/690.1 X |
| 3,053,025 | 9/1962 | Nigrelli et al. | 198/690.1 X |
| 3,342,018 | 9/1967 | Temple | 198/690.1 X |
| 3,727,758 | 4/1973 | Cleland | 414/793.3 X |
| 3,731,455 | 5/1973 | Theurer | 53/391 |
| 3,770,143 | 11/1973 | Breitbach | 414/793.3 X |
| 3,871,533 | 3/1975 | Mulcahy et al. | 53/236 X |
| 4,337,856 | 7/1982 | Dorner | 198/690.1 X |
| 4,351,430 | 9/1982 | Mojden | 198/690.1 |
| 4,358,236 | 11/1982 | Dudley | 198/690.1 X |

*Primary Examiner*—Daniel Moon

*Attorney, Agent, or Firm*—Ratner & Prestia

[57] ABSTRACT

A method and apparatus for putting small, slender, cylindrical cells in a box in an aligned row. By using the force of a magnet, multiple cells are suspended from the lower side of a conveyor belt, and are aligned and held in this position. By releasing the magnetic force, the cells drop, so that large numbers of cells, in a suspended and aligned state, can be simultaneously put into a cell container waiting below.

26 Claims, 4 Drawing Sheets

METHOD AND APPARATUS FOR PUTTING CELLS INTO A BOX

FIELD OF THE INVENTION

The present invention relates to a method for putting cells into a box during a battery manufacturing process.

BACKGROUND OF THE INVENTION

In a battery manufacturing process, the production process may be temporarily stopped to accumulate stock.

To save space when storing or for efficient utilization of the conveyance between steps during manufacturing, cells are often temporarily put into a box.

The present invention relates to a method of putting small cells such as UM3, UM4 and UM5 cells, which are slender and are difficult to stand individually in an upright position, into a box.

A conventional apparatus for putting small and slender cylindrical cells into a box is described with reference to the side view of a conventional apparatus in FIG. 7.

As shown in FIG. 7, cells 1 are sent from right to left in a horizontal position, by a continuously running belt conveyor 37. A star wheel 33 having twenty teeth coupled with and controlled by a single-rotation clutch (not shown), stops the cells waiting to be boxed at the right side of the star wheel 33.

A cell container 52 had an open top. The cells 1 are stacked in a plurality of layers in the cell container 52. To put cells (1) into the cell container 52, the cell container 52 is placed on its side with the open top adjacent the conveyor 37, and held in position by a container carrier (not shown). Twenty cells (1) correspond to one stack or layer for the cell container 52. A thin plate pusher 35 pushes twenty cells into the cell container 52. After every twenty cells (1), cell container 52 is lowered by a distance measured as corresponding to the height of one row, layer or stack of cells and the star wheel 33 turns one rotation.

To nearly stack the cells (1) into the cell container 52, the horizontal position of the cell container 52 is moved alternately right and left for each stack by a distance measured as ½ of the outer diameter of a cell. Thus, the cells (1) are stacked in a plurality of layers in the cell container 52. When a specified number of cells (1) are put into the cell container 52, the cell container 52 is returned to its normal position (the opening upward) by the container carder, and is replaced with a new empty cell container 52.

When the new empty cell container 52 is set in its specified position, the star wheel 33 is free to turn one rotation only. Twenty cells (1) are released from the star wheel 33, and are sent by the belt conveyor 37 until the leading cell hits a stopper 36 at the left end. The twenty cells (1) are then simultaneously pushed into container 52 by the thin plate pusher 35 (the drive unit is not shown) which is positioned adjacent to the row of cells and is movable in the direction perpendicular to the plane of the drawing. The pusher 35 is guided by a pusher guide 34.

By repeating the operation, the cells are put into the box.

To store 500 cells with an outer cell diameter 'D', the inner dimensions of the cell container should be; a width of 20.5 D, depth of 21.8 D corresponding to 25 stacks or rows of cells, and a length of about 10 to 20 mm longer than the cell length.

FIG. 6 is a plan view showing cells placed in a cell container 52. In FIG. 6, only some of the cells are shown, but actually there would be 25 layers when the box is full.

Small cells such as UM3 cells must be produced in large quantities and at high speed. This requires a high speed boxing process synchronized with the preceding and succeeding steps. Accordingly, the cells 1 are conveyed in a mw in a lying or horizontal position, and a high feed speed of about 700 mm/sec of conveyor 37 is required. As a result, increased noise occurs, and damage to the outer circumference of cells was often encountered.

To convey the cells in a stable upright position in the conventional cell manufacturing process, as shown in FIG. 8, a ring jig 38 made of a ring resin 39 with an iron ring 40 molded into its lower pan is used. To use such a ring jig 38 in the boxing process, however, requires an additional number of jigs and a space for each jig, and it is difficult to put a high density of cells in the cell container.

SUMMARY OF THE INVENTION

It is a primary goal of the invention to present a method and apparatus for putting a large quantity of cells into a box at high speed, without damage to the cells, and with reduced noise and vibration.

In a first aspect of the invention, the apparatus for putting cells into a box comprises a cell conveying means having a conveyor belt for conveying a plurality of cells, a (provisional) temporary cell holding means having a first magnet installed at a position close to the upper side of a boxing region of said conveyor belt, and a container conveying means to convey the cell container that accommodates a plurality of cells, the cells containing a ferromagnetic material.

In a second aspect of the invention, the method of putting cells into a box employs the above apparatus, and comprises the following steps. First, the predetermined numbers of cells are conveyed into the boxing region of the conveyor belt by the conveyor. Next, the bottom or cap of the cells are suspended, by the magnetic force acting through the conveyor belt 1 of the first magnet in a specified position to the lower side of the conveyor belt and conveyed to the boxing region. The the magnetic force applied to the suspended cells is released, and the cells released from the magnetic force are separated from the conveyor belt, and put into the cell container.

According to the first and second aspects, a large number of cells can be put into the cell container at high speed.

In the preferred embodiment, the cell conveying means has a second magnet installed at a position close to the upper side of the conveyor belt, in a region before the boxing region in the direction of movement of the conveyor belt. By the magnetic force of the second magnet, the plurality of cells are suspended on the upper side of the conveyor belt while being conveyed by the conveyor belt. The addition of the second magnet also reduces the generation of noise when conveying cells, and reduces damage to cells due to contact of cells with each other.

In the preferred embodiment, the cell container is positioned immediately beneath the first magnet and conveyor belt. The cell container opening faces the conveyor belt, and the cells released form the magnetic force fall into the cell container.

In the preferred embodiment, the first magnet and second magnet have a plurality of magnetic poles. By the magnetic force thereof, the cells are suspended to the lower side of the conveyor belt. This enables cells to be packed more densely.

In the preferred embodiment, the cells have a slender cylindrical shape, the bottom or cap of the cells has the ferromagnetic material, and the bottom or cap is suspended by the magnetic force of the first magnet or the second magnet. This eliminates the need for the jig for standing the cells up and simplifies the production process so cells can be packed more densely.

In another embodiment, a nonmagnetic plate is installed between the first magnet and the conveyor belt or between the second magnet and the conveyor belt The magnetic force for suspending the cells is controlled by adjusting the thickness of the nonmagnetic plate. This controls the magnetic force applied to the cells allows the cells to be packed more densely.

In the preferred embodiment, the cell container has a hole formed in its bottom and has a movable bottom plate inside the container. The container conveying means has a vertical movable support pin to be inserted into the hole. The relative position of the bottom plate to the top or open end of the cell container is adjusted by inserting the support pin through the bottom (lower side) of the cell container, and moving this support pin vertically. The cells are dropped into the adjusted bottom plate. This reduces the distance between the suspended cells and the bottom of the cell container, decreases the impact force acting on the cells and thereby reduces the occurrence of cell defects and disturbance of the alignment when dropping the cells.

Reference Numerals

Figure 1:
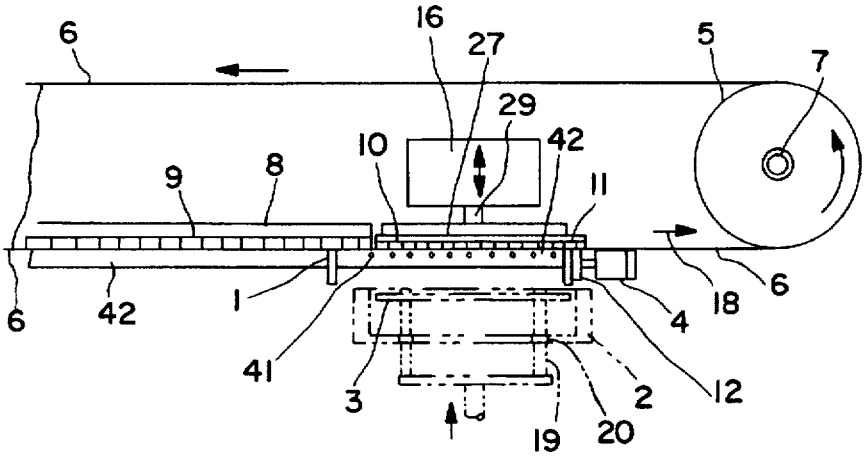
FIG. 1 is a fragmentary elevational view of an apparatus for putting cells into a box according to an embodiment of the invention.

1 Cylindrical cell
2 Cell container
3 Movable bottom plate
4 Driver cylinder for stopper
5 Drum for belt conveyor
6 Conveyor belt
7 Drum shaft for belt conveyor
8 Holding plate for magnet
9 Second permanent magnet
10 Holding plate for magnet
11 First permanent magnet
12 Stopper for cell
13 Cell container vertical drive cylinder
14 Bottom support pin drive cylinder
15 Holding plate oscillating guide bar
16 Drive cylinder for cell provisional holder
17 Nonmagnetic spacer
18 Arrow showing running direction of conveyor belt 6
19 Support pin for bottom plate
20 Bottom hole of container
21 Turntable
22 Shaft for turntable
23 Drive motor for turntable
24 Reduction gear
25 Gear
26 Bearing
27 Temporary Cell holding means
28 Actuator
29 Piston rod
30 Beam
31 Base
32 Arm
33 Star wheel
34 Pusher guide
35 Pusher
36 Stopper
37 Belt conveyor for conveying cell
38 Ring jig
39 Resin
40 Soft iron ring
41 Bridge breakage pin
42 Guide plate
52 Cell container

DETAILED DESCRIPTION OF THE INVENTION

A method for putting cells into a box according to the invention is described in detail below while referring to the accompanying drawings.

FIG. 1 is a schematic diagram used to explain a method and apparatus for putting cells into a box according to an embodiment of the invention. In FIG. 1, the apparatus for putting cells into a box comprises a cell conveying means having a conveyor belt 6 for conveying cells 1, a temporary cell holding means 27 for temporarily holding the conveyed cells 1, and a container conveying means having a container 2 for receiving the cells held by the temporary cell holding means 27. The conveyor belt 6 has a cell conveying unit for conveying cells, and a cell packing unit for packing the conveyed cells into the cell container 2. A second permanent magnet 9 is installed at a position close to the upper side of the conveyor belt 6 in the cell conveying unit. A first permanent magnet 11 is movably installed at a position close to the upper side of the conveyor belt 6 in the cell packing unit. The cell container 2 is movably installed at the lower side of the conveyor belt 6 in the cell packing unit. In FIG. 1, to simplify the drawing, the conveyor belt frame, base parts, drive unit, take-up unit, cylinder mounting unit, cell container conveying unit, and other cells are not shown.

Figure 2:
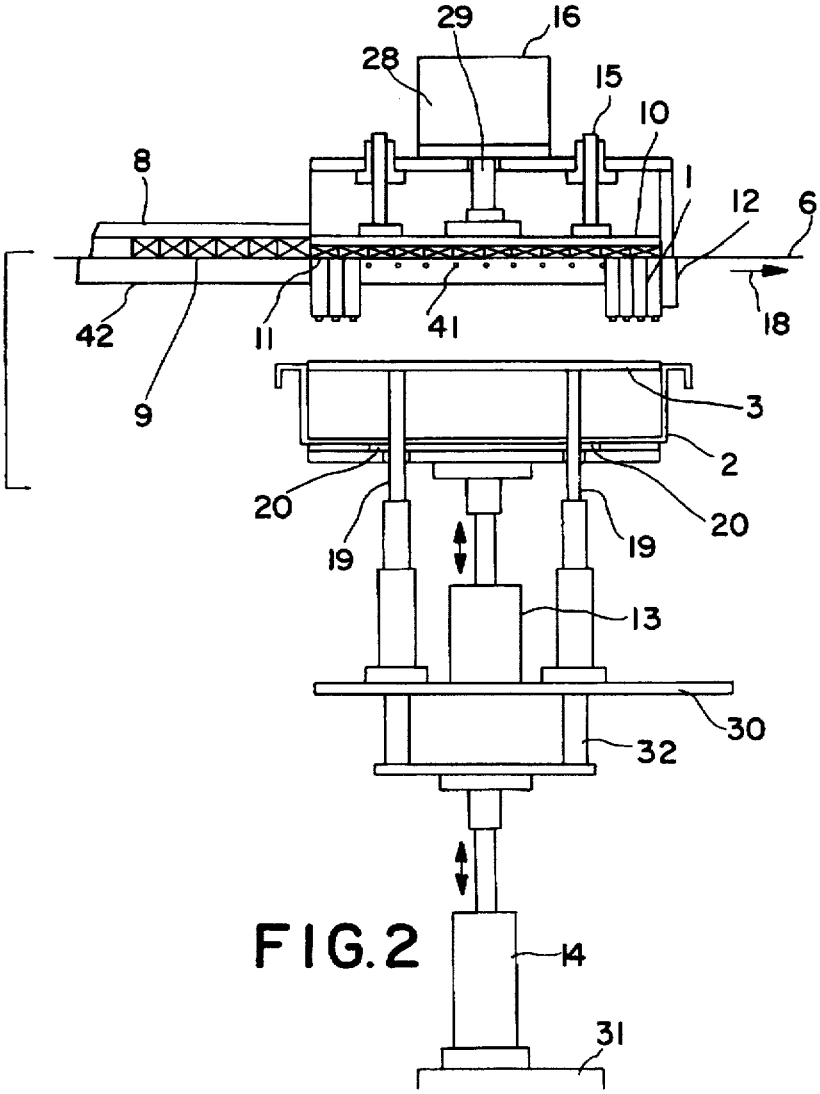
FIG. 2 is a partial sectional view showing principal parts of the apparatus of FIG. 1.

The conveyor belt 6 is wide, thin, and driven intermittently. As shown in FIG. 2, the conveyor belt 6 is driven by a drum 5 which rotates about a drum shaft 7. The second permanent magnet 9 having a plurality of magnetic poles, is mounted on the surface of a magnet holding plate 8 that has a smooth surface parallel to the surface of the conveyor belt 6, and its surface contacting the belt 6 is flat. The first permanent magnet 11 of the temporary cell holding means 27 is fixed to the surface of the flat magnet holding plate 10 so the surface of the first permanent magnet 11 may be flat and at the same height (in the same plane) as the surface of the second permanent magnet 9. The holding plate 10 can be driven vertically by a drive cylinder 16 which moves piston rod 29 fixed to plate 10.

Figure 4:
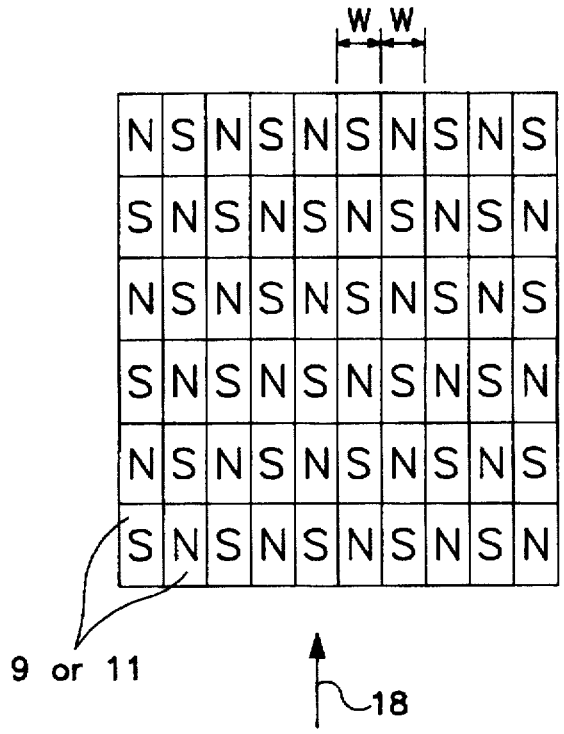
FIG. 4 is a plan view showing the layout of magnetic poles on a magnet holding plate, used in the method of an embodiment of the invention.
Figure 5:
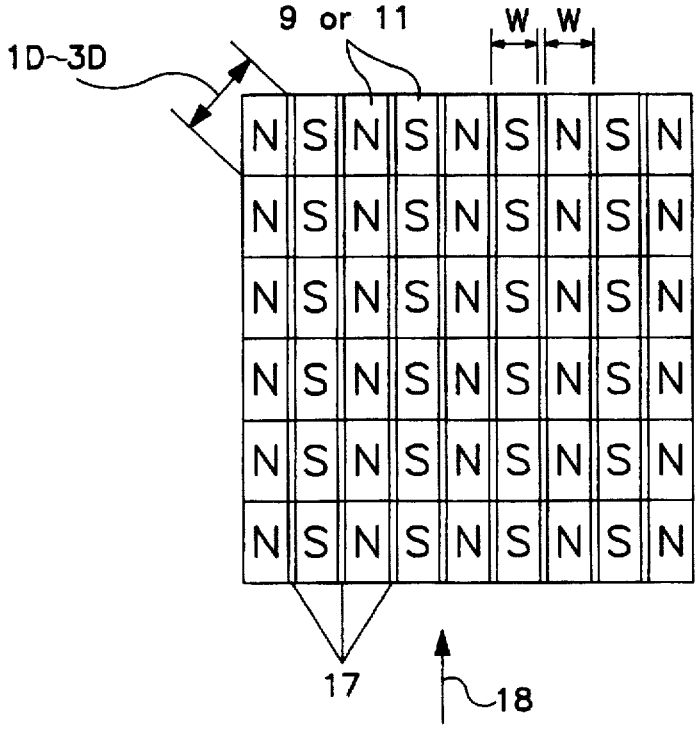
FIG. 5 is a plan view showing a layout of magnetic poles on a magnet holding plate, used in the method of another embodiment of the invention.
Figure 6:
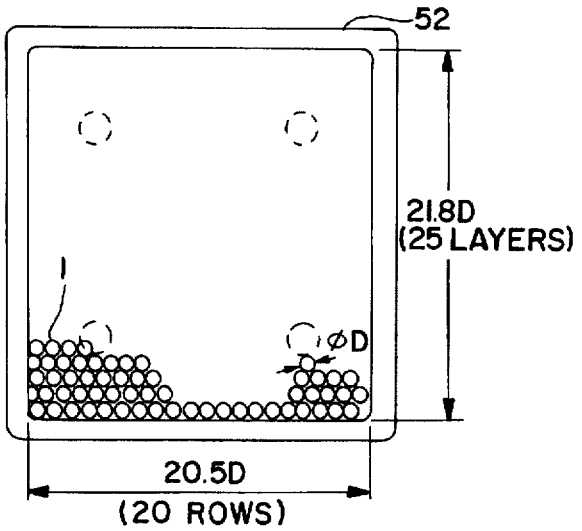
FIG. 6 PRIOR ART
FIG. 6 is a plan view of cells in a cell container according to the prior art.
Figure 7:
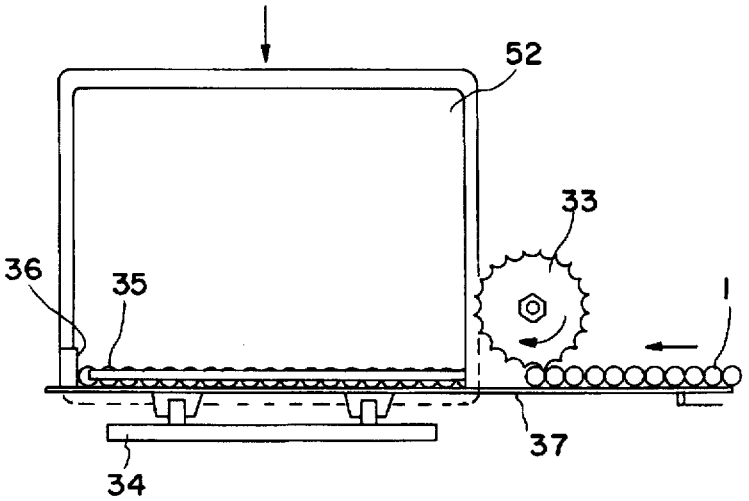
FIG. 7 PRIOR ART
FIG. 7 is an elevational view of a conventional apparatus for packing cells in a box.
Figure 8:
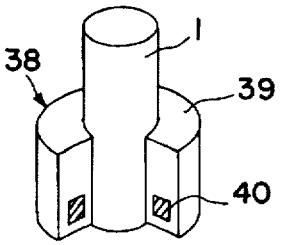
FIG. 8 PRIOR ART
FIG. 8 is a partially cut-away perspective view of a conventional jig used for conveying cylindrical cells.

The layout of the magnetic poles of the second permanent magnet 9 and first permanent magnet 11 is shown in FIG. 4 and FIG. 5. In FIG. 4 and FIG. 5, arrow 18 shows the direction of movement of the cells 1 (or conveyor belt 6).

In FIG. 4, the second permanent magnet 9 (and first permanent magnet 11) are arranged so the magnetic poles alternate. In FIG. 5, the second permanent magnet 9 (and first permanent magnet 11) is arranged so the magnetic poles in the vertical direction are the same and the magnetic poles in the lateral direction alternate. In FIG. 5, between magnetic poles of differing polarity, a thin nonmagnetic piece 17 is placed to prevent a short-circuit of magnetic flux between adjacent magnets. In the configuration in FIG. 5, the nonmagnetic piece 17 allows magnets of smaller thickness and weaker magnetic force to be used. The width of magnetic poles of the second permanent magnet 9 and first permanent magnet 11 are both W. Concerning the smoothness of motion in conveying the cells 1, the configuration in FIG. 5 is superior to the configuration in FIG. 4, but both are applicable.

In the cell conveying unit of FIG. 1, a plurality of cells (only one cell 1 is shown for simplicity of illustration) are suspended to the lower side of the conveyor belt 6, through the thin conveyor belt 6, by the magnetic force of the second permanent magnet. The cells are successively conveyed from left to right by the conveyor belt 6. As the conveyor belt 6 is advanced in the direction of arrow 18, cell 1 also moves to the right along with the movement of the conveyor belt 6. In the cell packing unit, the cell 1 attracted by the second permanent magnet 9 is attracted by the first permanent magnet 11 instead of the second permanent magnet 9 (in this condition, cell 1 is attracted and held by the (provisional) temporary cell holding means 27). Then cell 1 advances and hits a stopper 12 at the right side, and stops.

The stopper 12 is driven by a drive cylinder 4. At both sides of the conveyor belt 6, guide plates 42 having a width corresponding to the depth of the cell container 2 are provided. The number of cells 1 blocked from moving to the right by the stopper 12 gradually increases stacking to the left side of the stopper 12 as time passes. The left end of the temporarily stocked stacked cells spreads over the full width of the guide plate 42, and gradually extends to the left while sliding on the conveyor belt 6.

The cells often form a bridge due to frictional force acting mutually on their outer sides. As a result, alignment of the cells is disturbed, and a gap in the stack of cells is formed. This results in the specified number of cells not being contained in the cell container 2. To break this bridge, a shaking motion is applied to the outer side of the cells from a direction vertical to the running direction of the conveyor belt. The shaking motion is applied by reciprocal motion of a bridge breakage pin 41 by making use of an actuator 28 such as drive cylinder 16. The conveyor belt 6 is stopped temporarily when the length of cells 1 extending to the left from the stopper 12 becomes longer than the length corresponding to the width of the cell container 2 by a specified dimension. As a result, the cells are suspended from the lower side of the conveyor belt 6 and held in an aligned state, waiting for the packing operation in the cell packing unit.

When packing the cells, the cell container 2 is raised to and waits at a specified position by means of a support (not shown). The stopper 12 then moves slightly to the right, about 2 to 5 mm. This produces a slight clearance between outer sides of adjacent cells 1 that are packed densely on the conveyor belt 6, and the frictional force acting on the outer sides of the cells is almost eliminated. At this time, the first magnet 11 fixed on the magnet holding plate 10 is lifted 20 to 30 mm by raising the piston rod 29 of the drive cylinder 16. As a result, the cells 1 suspended through the conveyor belt 6 by the magnetic force of the first permanent magnet 11 are released from the magnetic force of the first permanent magnet 11. The cells 1 released from the magnetic force fall into the cell container 2 waiting at the lower side, and are packed.

To decrease the impact of the falling cells 1, a mechanism may be designed to shorten the free fall distance of the cells. A hole 20 is formed in the bottom of the cell container 2. A movable bottom plate 3 is installed in the cell container 2 and is supported by a movable support pin 19 penetrating through the hole 20. The support pin 19 moves the bottom plate 3 to a specified height. When the cells 1 fall on the bottom plate 3, the movable bottom plate 3 simultaneously descends smoothly to the bottom of the cell container 2 matching liming of the fall of cells 1.

It is possible to install a nonmagnetic plate (not shown) between the conveyor belt 6 and first permanent magnet 11, or between the conveyor belt 6 and second permanent magnet 9. By adjusting the thickness of the nonmagnetic plate, it is possible to control the distance between the suspended position of the cells 1 and the magnet holding plate 8, so the magnetic force for suspending the cells 1 can be controlled. With the nonmagnetic plate and conveyor belt 6 in contact with each other, smooth running of the conveyor belt 6 is realized.

PREFERRED EMBODIMENT

A preferred embodiment of the invention is described below while referring to FIG. 1, FIG. 2, and FIG. 3. In this embodiment, UM4 type manganese dry cells are used as the cells in describing the invention.

FIG. 2 is a sectional view of principal pans in FIG. 1. In FIG. 1, the conveyor belt 6 is a nonmagnetic flat belt with a width of 350 mm and thickness of about 1 to 2 mm, and at a slow speed of about 30 to 40 mm/sec, a plurality of cells are suspended on the lower side of the conveyor belt as it moves from left to right.

At the upper side of the conveyor belt 6, a plurality of ferrite permanent magnets are fixed as second permanent magnet 9, on the magnet holding plate 8 which made of ferromagnetic material. The second permanent magnet 9 is positioned so it lightly contacts the conveyor belt 6. At the upper side of the terminal end region of the right end of the conveyor belt 6, a plurality of alnico permanent magnets are fixed as the first permanent magnet 11, on the magnet holding plate 10 made of ferromagnetic material. The first permanent magnet 11 can move vertically being driven by the drive cylinder for the temporary cell holding means 16. The first permanent magnet 11 is positioned so it lightly contacts the conveyor belt 6. As shown in FIG. 2, the magnet holding plate 10 is guided by a slide guide bar 15. The second permanent magnet 9 and first permanent magnet 11 suspend the cells 1 on the lower surface of the conveyor belt 6.

A nonmagnetic plate (not shown) such as a brass plate or a stainless steel plate of about 0.1 to 0.5 mm thickness, may be placed between the conveyor belt 6 and second permanent magnet 9, or between the conveyor belt 6 and first permanent magnet 11. The placement of the nonmagnetic plate is effective to prevent dislocation or dropout of the cells and to provide smooth running of the belt. For the weight of the cells 1, if the magnetic attraction force of the second permanent magnet 9 is too weak, the cells 1 are likely to drop off the conveyor belt 6 while being conveyed by the conveyor belt 6. If the magnetic attraction force of the second permanent magnet 9 is too strong, the suspended cells 1 are likely to tilt down to a lateral position due to the impact or vibration of the conveying process, and may be attracted in the lateral or horizontal position on the lower side of the conveyor belt 6. In addition, if the magnetic attraction force is too strong, the load applied on the drive motor 23 increases and belt life may be shortened. Therefore, magnets having the proper magnetic force are selected and used for the first permanent magnet 11 and second permanent magnet 9.

The layout of magnetic poles of the first permanent magnet 11 and second permanent magnet 9 are shown in FIG. 5. In FIG. 5, arrow 18 indicates the running direction of the conveyor belt 6. If the outer diameter of the cell 1 is D, the length of the diagonal line of magnetic poles is between 1D to 3D.

In FIG. 2, when the conveyed cell 1 hits the stopper 12 near the right end of the conveyor belt 6, progress of the cell 1 is blocked. As the quantity of cells 1 at the left side of the stopper 12 gradually increases the cells spread to the full width of the conveyor belt 6 until the cells 1 hit the guide plates 42 provided on both sides of the conveyor belt 6. The rear end of the cells 1 prevented from being conveyed by the conveyor belt 6 by the stopper 12 is gradually extended in the left hand direction. With the opening of the cell container 2 and with more than five hundred cells 1 at the position adjacent the magnet holding plate 10, movement of the conveyor belt 6 is temporarily suspended.

In the cell containing unit, the cells 1 are suspended on the lower side of the conveyor belt 6 by the magnetic force of the first permanent magnet 11. The stopper 12 is then moved about 2 to 5 mm to the right by the drive cylinder 4. A slight gap is formed between the stopper 12 and guide plate 42 and the frictional force acting between adjacent cells is almost eliminated. The drive cylinder 16 for temporary cell holding means 27 is then actuated, and the first permanent magnet 11 is raised by about 30 mm from the position shown in FIG. 2. As a result, the cells 1 attracted to the lower side of the conveyor belt 6 are released from the attraction force of the first permanent magnet 11. The cells 1 released from the magnetic force fall, and are put into the cell container 2 waiting below. At this time, the cell container 2 is temporarily lifted by the cylinder 13 fixed to the beam 30. To shorten the falling distance of the cells 1 and lessen the impact force acting on the cells 1, the movable bottom plate 3 is lifted and supported nearly to the top open edge of the container 2 by the bottom plate support pin 19. The movable bottom plate 3 falls at a rate coinciding with the rate of the fall of the cell 1 and packing of the cells is completed.

In FIG. 2, the base 31 supports the cylinder 14. The pin 19 is attached to the arm 32. For ease of maintenance, the installed height of the conveyor belt 6 is preferred to be about 1 to 2.5 m.

Figure 3:
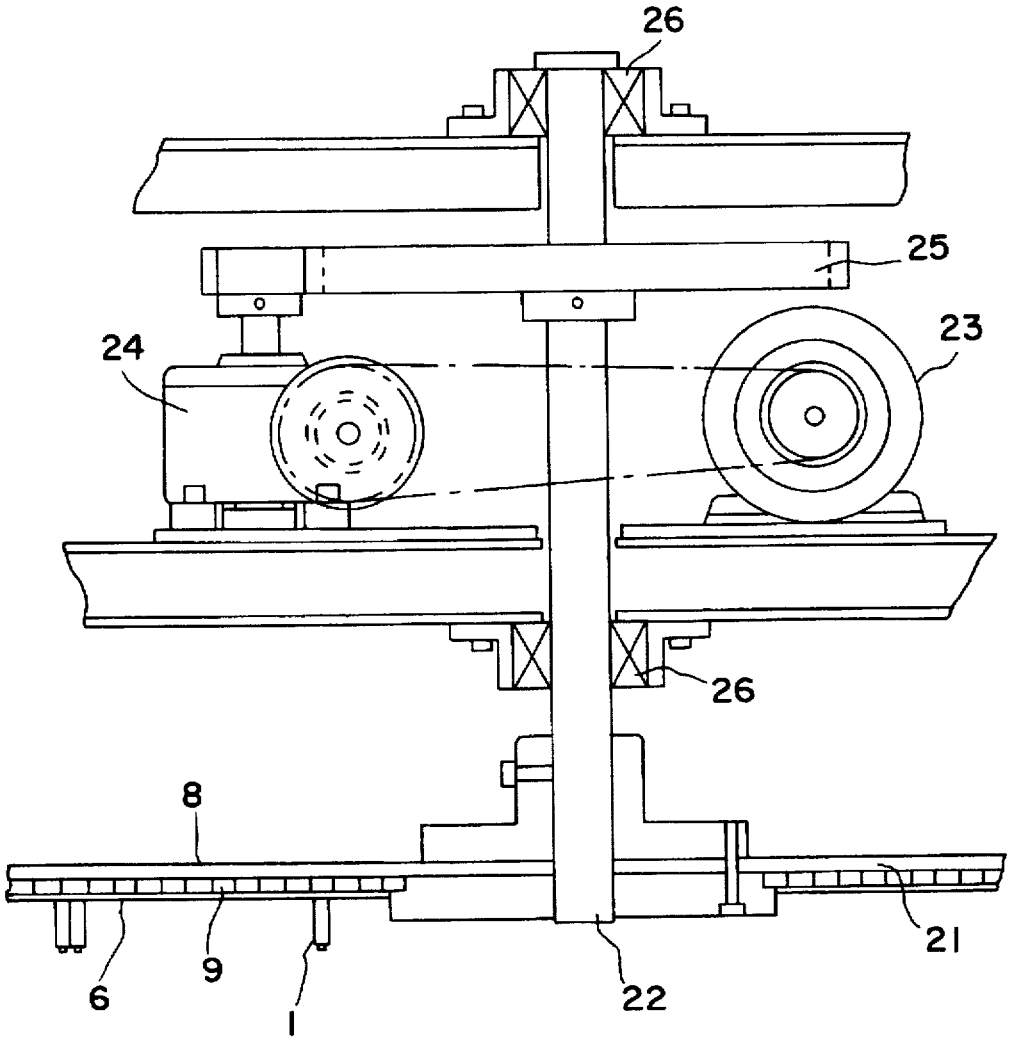
FIG. 3 is a schematic side sectional view of the turntable unit used in the invention.

In the cell conveying unit of the invention, a turntable type cell conveying means such as shown in FIG. 3 may also be used. It is also possible to employ both cell conveying means in the cell conveying unit, of a nearly straight form such as shown in FIG. 1, and the turntable type such as shown in FIG. 3.

FIG. 3 is a schematic diagram of the mintable unit used as one of the cell conveying means in an embodiment of the invention. In FIG. 3, a disk-shaped turntable 21 mounted on shaft 22 is driven through drive motor 23, reduction gear 24, and gear 25. The shaft 22 is held by a bearing 26. For the simplicity of drawing, the frame and bases of the turntable are not shown. The number of cells 1 suspended on the turntable 21 is limited to a very small number as shown in the drawing. The diameter of the turntable 21 is preferably about 1.0 to 1.8 m.

For those cylindrical cells having a bottom or cap suspended by the force of the magnets on the lower side of the conveyor belt gravity acting on the cell acts as the force for preventing tilting of the cells, and the magnetic attraction force suddenly becomes weak as the distance from the permanent magnet increases. Therefore, it is not necessary to use any jig to prevent tilting and the cells may be conveyed and packed very efficiently.

The method and apparatus of this embodiment for putting cells in a box bring about the following effects.

A great number of cells can be put into a cell container at high speed.

Generation of noise while conveying cells, and damage to outer sides of cells due to mutual contact of cells is reduced.

Cells can be packed more densely.

The production process is simplified by not requiring a jig for setting up the cells.

The distance between the suspended cells and the bottom plate of the cell container is shortened, and the impact force acting on the cells is decreased reducing the occurrence of cell damage and disturbances of alignment as a cell falls.

Electromagnets can be used instead of the first permanent magnet and second permanent magnet. In this case, the magnetic force of the magnet can be released by turning off the power supply to the electromagnet. Similarly, the magnetic force of the magnet can be controlled by adjusting the current applied to the electromagnet.

What is claimed is:

1. A method of putting cells into a box, comprising the steps of:

(a) manufacturing cells, each cell having a ferromagnetic member, (b) preparing a cell-boxing-device comprising a cell conveying means having a conveyor belt for conveying said plurality of cells, a temporary cell holding means including a first magnet installed proximate to the upper side of a boxing region of said conveyor belt, and a container-conveying means having a cell container receiving said cells for, (c) conveying said cells to said boxing region by means of said conveyor belt, (d) suspending said cells in a predetermined position to the lower side of said boxing region of said conveyor belt by force of said first magnet, and (e) releasing said magnetic force applied to said suspended cells, separating said cells released from said magnetic force from said conveyor belt, and putting said cells into said cell container.

2. A method according to claim 1, wherein said cell conveying means has a second magnet installed at a position close to the upper side of said conveyor belt in a region adjacent said boxing region in a running direction of said conveyor belt, and said plurality of cells is conveyed through said region by suspending said plurality of cells to said lower side of said conveyor belt by a magnetic force of said second magnet acting through said conveyor belt.

3. A method according to claim 2, wherein said first magnet has a first plurality of magnetic poles, and said second magnet has a plurality of magnetic poles.

4. A method according to claim 1, wherein said cell container is positioned immediately beneath said belt and said first magnet, said cell container has an opening at its upper side, said cells released from said magnetic force fall into said cell container.

5. A method according to claim 1, wherein said first magnet is a permanent magnet, and said temporary cell holding means has a vertical moving plate, and said first permanent magnet is fixed to a lower side of said plate.

6. A method according to claim 1, wherein the magnetic force applied to said cells is released by moving the first magnet upward.

7. A method according to claim 1, wherein said container-conveying means has a mechanism for vertically moving said cell container, said cells are dropped into said cell container, with said cell container in a position immediately beneath and near said cells suspended by said magnetic force.

8. A method according to claim 1, wherein said first magnet has a plurality of magnetic poles, and said cells are suspended on said lower side of said conveyor belt, corresponding to said plurality of magnetic poles.

9. A method according to claim 1, wherein each of said cells is in a slender cylindrical shape, a bottom of each cell has said ferromagnetic member, and said bottom is suspended from said lower side of said conveyor belt, by said magnetic force of said first magnet acting through said conveyor belt.

10. A method according to claim 1, wherein each cell of said cells has a slender cylindrical shape, a cap of each cell has said ferromagnetic member, and said cap is suspended from said lower side of said conveyor belt, by said magnetic force of said first magnet acting through said conveyor belt.

11. A method according to claim 1, wherein said temporary cell holding means has a nonmagnetic plate installed between said first magnet and said conveyor belt, and said magnetic force for suspending said plurality of cells is controlled by adjusting the thickness of said nonmagnetic plate.

12. A method according to claim 1, wherein said cell container has a hole formed in its bottom and a movable bottom plate, said container conveying means has a vertical movable support pin inserted in said hole, the relative position of said bottom plate to said cell container is adjusted by inserting said support pin from the bottom side of the cell container, and moving said support pin vertically, and said cells are put on said adjustable bottom plate.

13. A method according to claim 1, wherein said cell-conveying means has a second magnet installed at a position close to the upper side of said conveyor belt in a region adjacent said boxing region each cell is cylindrical in shape, a bottom and cap of said each cell having said ferromagnetic member, and one of the bottom and the cap of said each cell is suspended from the lower side of said conveyor belt by a magnetic force acting through said conveyor belt.

14. A method according to claim 1, wherein said first magnet is a first electromagnet.

15. A method according to claim 1, wherein said first magnet is a first electromagnet, and said magnetic force applied to said suspended plurality of cells is released by turning off power supplied to said first electromagnet.

16. A method of putting cells in a box comprising the steps of:

(a) manufacturing cylindrical cells, each cell having a ferromagnetic member, (b) preparing a cell-boxing-device comprising a cell-conveying means having a conveyor belt and a second permanent magnet installed at a position proximate to an upper side of said conveyor belt, a temporary cell holding means positioned proximate to an upper side of a terminal end region of said conveyor belt, and having a first permanent magnet fixed beneath a vertical movable plate, and a container-conveying means having a cell container having an opening at a upper side for receiving said cylindrical cells, (c) suspending said cylindrical cells from a lower side of said conveyor belt, by a magnetic force of said second permanent magnet acting through said conveyor belt, (d) conveying said suspended cylindrical cells to said terminal end region of said conveyor belt, (e) aligning said cylindrical cells in said terminal end region of said conveyor belt, while suspending said cells from the lower side of said conveyor belt, by magnetic force of said first permanent magnet acting through said conveyor belt, (f) moving said opening of said cell container immediately beneath said temporary cell holding means, and (g) releasing said magnetic force applied to said suspended plurality of cylindrical cells, thereby dropping said cylindrical cells released from said magnetic force into said cell container.

17. A method according to claim 16, wherein at least one member of a bottom and a cap of said cell has said ferromagnetic member, said ferromagnetic member is suspended from the lower side of said conveyor belt, by said magnetic force of said first magnet and said second magnet, said temporary cell holding means has a nonmagnetic plate having a thickness installed between said first magnet and said conveyor belt, and said magnetic force for suspending said plurality of cells is controlled by adjusting the thickness of said nonmagnetic plate.

18. A method according to claim 16, wherein said cell container has a hole formed in its bottom and a movable bottom plate, said container conveying means has a vertical movable support pin to be inserted into said hole, a relative position of said bottom plate to said cell container is adjusted by inserting said support pin from the bottom side of the cell container and moving said support pin vertically, and said plurality of cells are dropped onto said adjusted bottom plate.

19. A method according to claim 16, wherein said first magnet has a plurality of magnetic poles, said second magnet has a plurality of magnetic poles, said first magnetic poles have N poles and S poles arranged alternately in a direction parallel to a running direction of said conveyor belt, and said second magnetic poles have N poles and S poles arranged alternately in a direction parallel to the running direction of said conveyor belt.

20. A method according to claim 19, wherein said first magnet and said second magnet have a nonmagnetic spacer interposed between said N poles and said S poles.

21. A method according to claim 16, wherein step (e) is followed by a step of applying a shaking action to said suspended cylindrical cells to improve alignment of said cylindrical cells.

22. An apparatus of putting cells in a box comprising:

(a) a cell-conveying means having a conveyor belt for conveying cells, each of said cells having a ferromagnetic member, and a second magnet installed at a position proximate an upper side of said conveyor belt, (b) a temporary cell holding means having a first magnet installed at a position proximate an upper side of a terminal end region of said conveyor belt, and (c) a container-conveying means having a movable cell container installed below said terminal region of said conveyor belt, for conveying said cell container, wherein said cells are conveyed into said terminal region of said conveyor belt, said cells being suspended from said lower side of said conveyor belt, by magnetic force of said second magnet, said conveyed cells, in said terminal end region, are suspended from a lower side of said conveyor belt, by a magnetic force of said first magnet, and said cells suspended by said first magnet are separated from said conveyor belt by release of said magnetic force of said first magnet, and put into said cell container.

23. An apparatus according to claim 22, wherein said first magnet has a plurality of magnetic poles, and said second magnet has a plurality of magnetic poles.

24. An apparatus according to claim 22, wherein said cell container has a hole formed in its bottom and a movable bottom plate, said container conveying means has a vertical movable support pin to be inserted into said hole, a relative position of said bottom plate to said cell container is adjusted by inserting said support pin from the bottom of the cell container, and moving said support pin vertically, and said cells are put on said adjusted bottom plate.

25. An apparatus according to claim 22, wherein each cell is cylindrical in shape, a bottom and a cap of each cell has said ferromagnetic member, and said cell-conveying means is constructed to suspend and convey one of said bottom and cap of said cell from the lower side of said conveyor belt.

26. An apparatus according to claim 22, wherein said cell-conveying means has said conveyor belt in the shape of a turntable and said second magnet.

* * * * *